US006223468B1

(12) United States Patent
Kobayashi

(10) Patent No.: US 6,223,468 B1
(45) Date of Patent: May 1, 2001

(54) ELECTRIC DOOR CLOSURE

(75) Inventor: Fumio Kobayashi, Kanagawa (JP)

(73) Assignee: Ohi Seisakusho Co., Ltd., Yokohama (JP)

( * ) Notice: Subject to any disclaimer, the term of this patent is extended or adjusted under 35 U.S.C. 154(b) by 0 days.

(21) Appl. No.: 09/219,369

(22) Filed: Dec. 23, 1998

(30) Foreign Application Priority Data

Dec. 26, 1997 (JP) ..... 9-359710
Dec. 26, 1997 (JP) ..... 9-359711

(51) Int. Cl.[7] ..... E05F 15/12
(52) U.S. Cl. ..... 49/280; 292/201
(58) Field of Search ..... 49/280, 282, 283, 49/284, 285, 291, 293, 334, 360; 292/201, 216, DIG. 23

(56) References Cited

U.S. PATENT DOCUMENTS

| | | | | |
|---|---|---|---|---|
| 4,746,153 | * | 5/1988 | Compeau et al. | 292/216 |
| 4,796,932 | * | 1/1989 | Tame | 292/112 |
| 4,861,089 | * | 8/1989 | Compeau et al. | 296/76 |
| 5,411,302 | * | 5/1995 | Shimada | 292/201 |
| 5,429,400 | * | 7/1995 | Kawaguchi et al. | 292/201 |
| 5,454,607 | * | 10/1995 | Ishihara et al. | 292/201 |
| 5,516,164 | | 5/1996 | Kobayashi | 292/201 |
| 5,632,515 | * | 5/1997 | Dowling | 292/216 |
| 5,640,807 | * | 6/1997 | Shigematsu et al. | 49/449 |
| 5,876,074 | * | 3/1999 | Dowling | 292/201 |
| 6,070,921 | * | 6/2000 | Valasin | 292/216 |

FOREIGN PATENT DOCUMENTS 2-4754 1/1990 (JP) .

* cited by examiner

*Primary Examiner*—Daniel P. Stodola
*Assistant Examiner*—Curtis A. Cohen
(74) *Attorney, Agent, or Firm*—Foley & Lardner

(57) ABSTRACT

An electric door closure comprises a rotation lever connected to a first rotation shaft of a latch plate to rotate therewith. An electric door actuator is mounted in a lock proper. An arm member is pivotally connected to the lock proper through a second rotation shaft which is angled relative to the first rotation shaft. The arm member is pivoted by an electric actuator between the arm member being pivoted by an electric actuator between an operative position and an inoperative position. A connecting lever pivotally connects the arm member through a third rotation shaft which extends in parallel with the second rotation shaft. The connecting lever is movable between an engaging position, wherein, when the arm member is pivoted from the inoperative position to the operative position, a press portion is formed on the connecting lever to push an edge of the rotation lever to pivot the latch plate from the half-latched position to the full-latched position and a canceling position wherein the press portion is separated from the rotation lever in a direction perpendicular to a major surface of the rotation lever. The press portion is in abutment with the edge of the rotation lever to suppress the connecting lever from moving toward the engaging position, when the latch plate is in a zone between the open position and just before the half-latch position. An open lever is provided which moves the connecting lever and the locking plate to the respective canceling positions when actuated in a certain direction. A biasing spring is provided for biasing the connecting lever toward the engaging position.

8 Claims, 8 Drawing Sheets

ELECTRIC DOOR CLOSURE

BACKGROUND OF THE INVENTION

1. Field of the Invention

The present invention relates in general to door closures and more particularly to electric door closures incorporated with a door lock device, which enforcedly close a door with the aid of electric power. More specifically, the present invention is concerned with electric door closures of a type which enforcedly moves a door to a so-called full-latch position with the aid of electric power when the door moves from an open position to a so-called half-latch position.

2. Description of the Prior Art

In order to clarify the task of the present invention, a known electric door closure shown in Japanese Patent Second Provisional Publication 2-4754 will be outlined in the following.

The electric door closure of the publication is incorporated with a back door lock device. The back door lock device generally comprises a lock proper mounted on a pivotal back door and a striker mounted on a rear portion of a vehicle body. Upon closing of the back door, the lock proper catches the striker to hold the door in a closed and latched position. The electric door closure includes a rotating plate fixed to a latch plate shaft of the lock proper, a lever pivotally connected to the rotating plate, a position sensor for sensing the position of the latch plate and an electric motor for actuating the latch plate through the lever and the rotating plate. That is, when the position sensor senses that the latch plate has turned from an open position wherein the latch plate releases the striker to a half-latch position wherein the latch plate incompletely engages with the striker, the electric motor becomes energized to force, through the lever and the rotating plate, the latch plate to pivot from the half-latch position to a full-latch position wherein the latch plate fully engages with the striker. Due to this movement, the back door is shifted to its fully closed and latched position relative to the vehicle body.

In the electric door closure of the publication, a measure is employed for permitting a free movement of the latch plate and the rotating plate when the electric door closure is under OFF condition. That is, in the measure, for preventing the lever from interrupting the movement of the latch plate and the rotating plate in such OFF condition, there is provided between the lever and the rotating plate a play of an amount corresponding to a rotation angle of the latch plate between the open position and the half-latch position.

However, due to provision of this play, upon operation of the electric door closure, the lever is subjected to an inoperative condition for a certain period from the time when the motor is energized to the time when the lever actually drives the latch plate. Thus, the electric door closure fails to achieve a quick door closing action.

SUMMARY OF THE INVENTION

It is therefore an object of the present invention to provide an electric door closure incorporated with a door lock device, which is free of the above-mentioned drawback.

That is, according to the present invention, there is provided an electric door closure incorporated with a door lock device, which can quickly shift a door from the half-latch position to the full-latch position upon energization of an electric actuator.

According to the present invention, there is further provided an electric door closure incorporated with a door lock device, which assures a reliable and smoothed open/close movement of a door.

According to a first aspect of the present invention, there is provided an electric door closure which is incorporated with a door lock device. The door lock device includes a striker mounted on one of a fixed structure and a door movably connected to the fixed structure, and a lock proper mounted on the other of the fixed structure and the door, the lock proper including a latch plate which can pivot to an open position, a half-latch position and a full-latch position and a locking lever which can engage the latch plate to assure the half-latch and full-latch positions of the latch plate. The electric door closure comprises a rotation lever connected to a first rotation shaft of the latch plate to rotate therewith; an electric actuator mounted in the lock proper; an arm member pivotally connected to the lock proper through a second rotation shaft which is angled relative to the first rotation shaft, the arm member being pivoted by the electric actuator between an operative position and an inoperative position; a connecting lever pivotally connected to the arm member through a third rotation shaft which extends in parallel with the second rotation shaft, the connecting lever being movable between an engaging position wherein when the arm member is pivoted from the inoperative position to the operative position, a press portion formed on the connecting lever pushes an edge of the rotation lever to pivot the latch plate from the half-latch position to the full-latch position and a canceling position wherein the press portion is separated from the rotation lever in a direction perpendicular to a major surface of the rotation lever, the press portion being in abutment with the edge of the rotation lever to suppress the connecting lever from moving toward the engaging position when the latch plate is in a zone between the open position and just before the half-latch position; an open lever which moves the connecting lever and the locking plate to the respective canceling positions when actuated in a certain direction; and biasing means for biasing the connecting lever toward the engaging position.

According to a second aspect of the present invention, there is provided an electric door closure which is incorporated with a door lock device. The door lock device includes a striker mounted on one of a fixed structure and a door movably connected to the fixed structure, and a lock proper mounted on the other of the fixed structure and the door, the lock proper including a latch plate which can pivot to an open position, a half-latch position and a full-latch position and a locking lever which can engage the latch plate to assure the half-latch and full-latch positions of the latch plate. The electric door closure comprises a rotation lever connected to a shaft of the latch plate to rotate therewith; an electric actuator mounted in the lock proper; an arm member pivotally connected to the lock proper, the arm member being pivoted by the electric actuator between an operative position and an inoperative position; a connecting lever pivotally connected to the arm member, the connecting lever being movable between an engaging position wherein when the arm member is pivoted from the inoperative position to the operative position, a press portion formed on the connecting lever pushes an edge of the rotation lever to pivot the latch plate from the half-latch position to the full-latch position and a canceling position wherein the press portion is separated from a way of the rotation lever; biasing means for biasing the connecting lever toward the engaging position; and a stopper to which a projection of the connecting lever abuts when the arm member is pivoted from a neutral position between the operative and inoperative positions to the inoperative position, so that the connecting lever is pivoted to the canceling position.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, an electric door closure of the present invention will be described in detail with reference to the drawings.

In the description, direction representing terms, such as, right, left, upward, downward, front, rear and the like are to be understood with respect to a drawing or drawings on which the objective part or parts to which the description is directed are illustrated.

Referring to FIGS. 1 to 5, there is shown an electric door closure of the present invention, which is operatively installed in a back door lock device.

Figure 2:
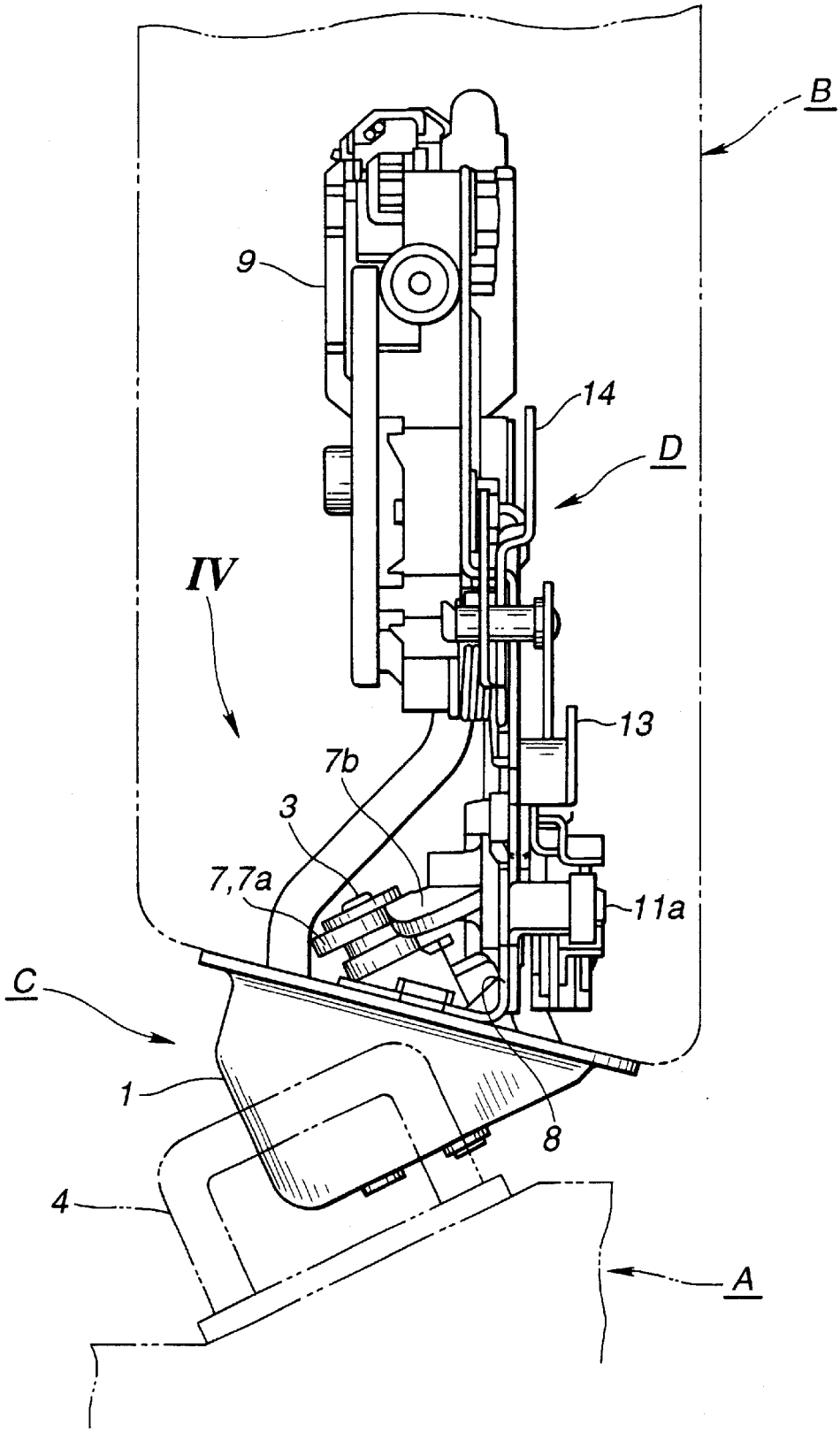
FIG. 2 is a side view of the electric door closure of the present invention with the electric motor mounted thereto.

As is seen from FIG. 2, the back door lock device comprises a striker 4 mounted on a rear portion of a vehicle body "A" and a lock proper "C" mounted on a pivotal back door "B". Although not shown in the drawings, the back door "B" has an upper end hinged to an upper portion of the vehicle body "A".

Figure 5:
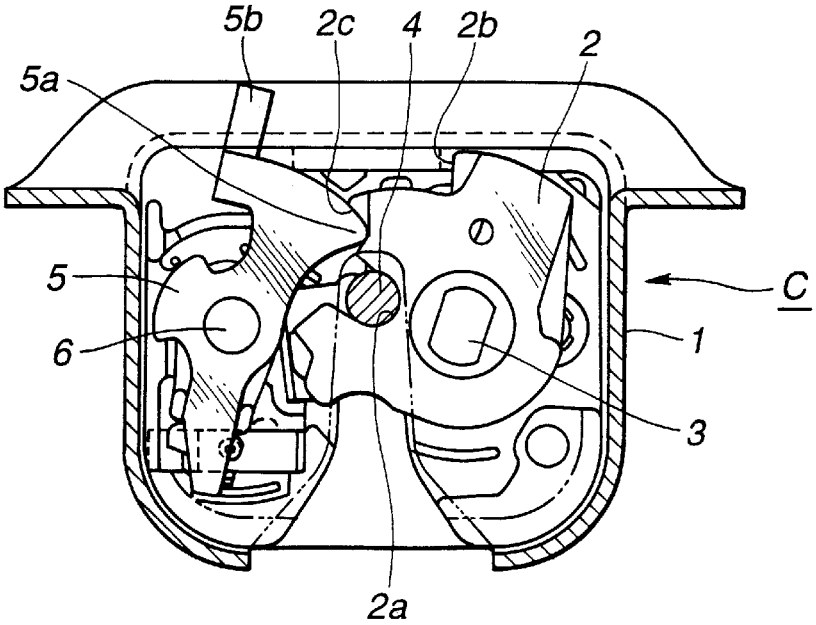
FIG. 5 is a sectional view taken along the line "V—V" of FIG. 1.

As is seen from FIG. 5, the lock proper "C" comprises a housing 1 fixed to a lower end of the pivotal back door "B" (see FIG. 2). A latch plate 2 and a locking plate 5 are pivotally installed in the housing 1. That is, the latch plate 2 is fixed to a shaft 3 pivotally held in the housing 1. The latch plate 2 is formed with a latching recess 2*a* engageable with the striker 4, and two stepped portions 2*b* and 2*c* which are engageable with the locking plate 5. The locking plate 5 is pivotally connected to the housing 1 through a shaft 6. The locking plate 5 is formed with a pawl portion 5*a* engageable with the stepped portions 2*b* and 2*c* of the latch plate 2. The locking plate 5 has further an upwardly bent engaging lug 5*b*. Although not shown in the drawing, springs are employed for biasing the latch plate 2 in a counterclockwise direction and the locking plate 5 in a clockwise direction in FIG. 5.

Figure 1:
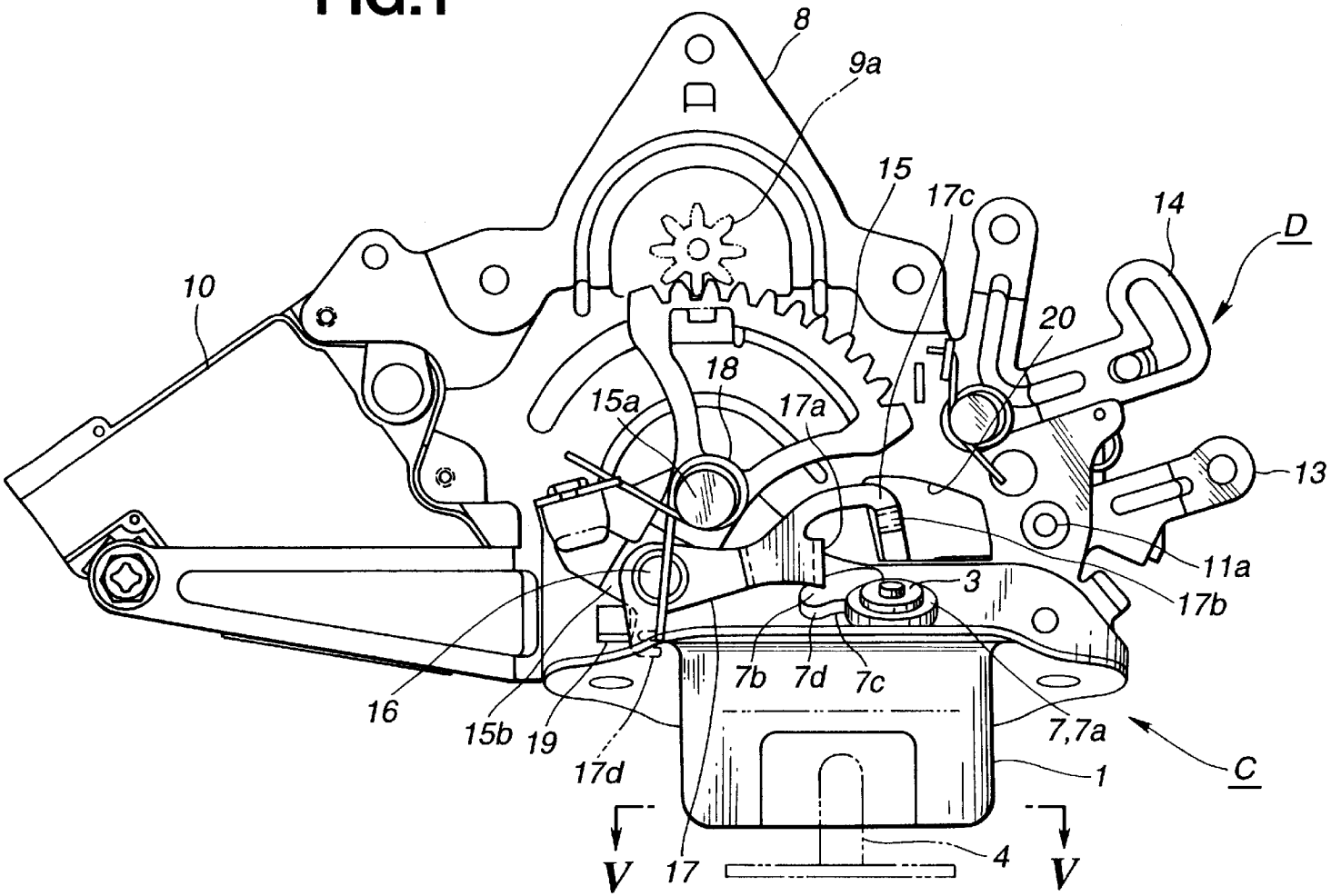
FIG. 1 is a front view of an electric door closure of the present invention with an electric motor removed.
Figure 4:
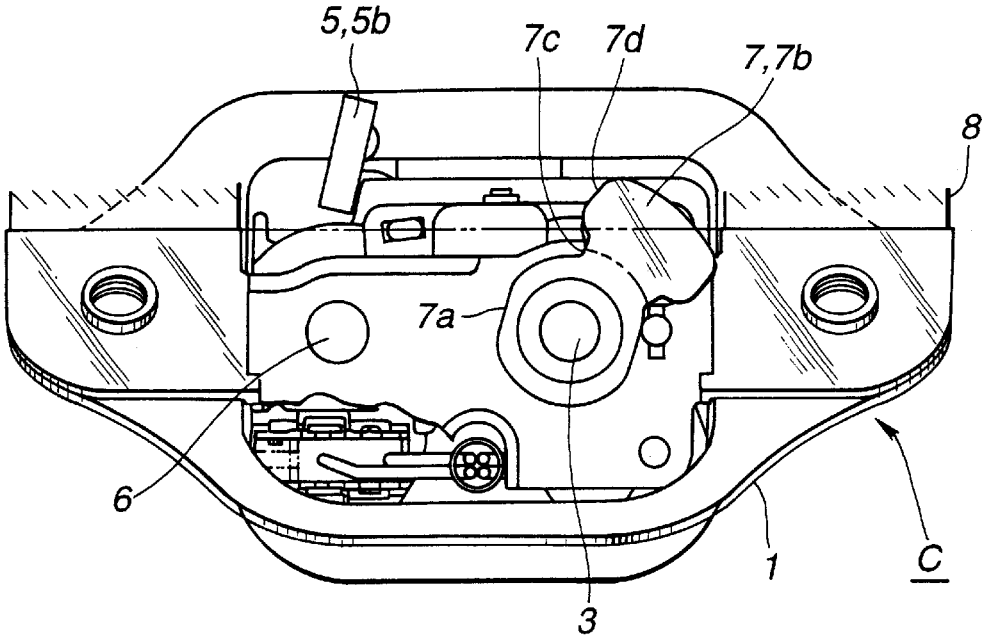
FIG. 4 is a view taken from the direction of the arrow "IV" of FIG. 2.

As is seen from FIGS. 1 and 4, to an upper end of the latch plate shaft 3, there is fixed a rotation lever 7. Thus, the rotation lever 7 and the latch plate shaft 3 can pivot as a unit.

As is well seen from FIG. 4, the rotation lever 7 comprises a circular base part 7*a* disposed about the latch plate shaft 3, a leading part 7*b* radially extending from the base part 7*a* and a reduced neck part 7*c* formed between the base part 7*a* and the leading part 7*b*.

As is seen from FIG. 1, the leading part 7*b* of the rotation lever 7 is bent by a certain angle relative to the base part 7*a*, so that the leading part 7*b* extends generally in parallel with a pivot shaft 15*a* of an after-mentioned arm member 15*b*. As is seen from FIG. 4, the leading part 7*b* is formed with an arcuate left edge 7*d* against which a push portion 17*a* of an after-mentioned connecting lever 17 can abut.

Figure 11:
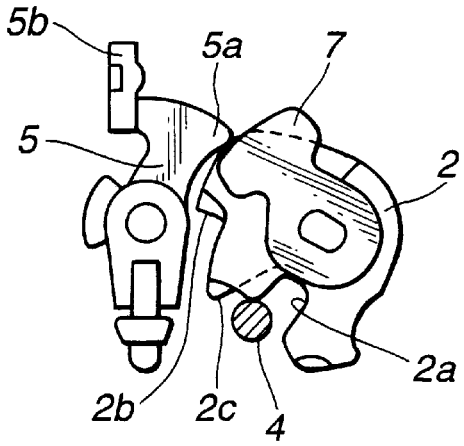
FIG. 11 is a front view of an essential portion of a lock mechanism, showing a condition wherein a latch plate assumes a striker release position.
Figure 12:
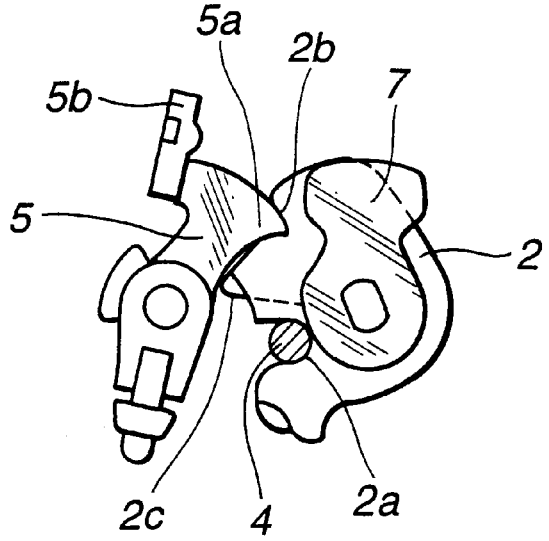
FIG. 12 is a view similar to FIG. 11, but showing a condition wherein the latch plate assumes a half-latch position.
Figure 13:
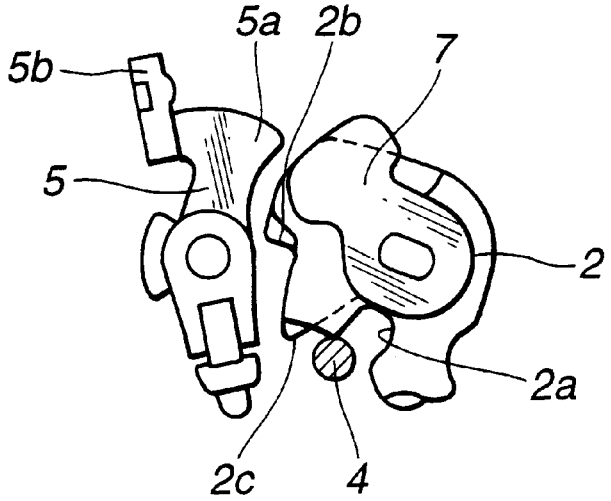
FIG. 13 is a view similar to FIG. 11, but showing a condition wherein the latch plate is being operated to release the striker.

When the back door "B" is opened, the latch plate 2 (and thus the rotation lever 7) assumes an open position wherein, as shown in FIG. 11, the latch plate 2 releases the striker 4. While, when the back door "B" is pivoted down to an almost-closed position, the latch plate 2 halfly or incompletely catches the striker 4 by loosely putting the striker 4 in the latching recess 2*a* thereof and the pawl portion 5*a* of the locking plate 5 engages with the stepped portion 2*b* of the latch plate 2 to suppress pivoting of the latch plate 2 toward the open position. This condition is depicted by FIG. 12. That is, under this condition, the back door "B" assumes a half-latch position. When the back door "B" is fully closed, the latch plate 2 fully or completely catches the striker 4 with the latching recess 2*a* and the pawl portion 5*a* of the locking plate engages with the other stepped portion 2*c* of the latch plate 2 thereby to completely suppress pivoting of the latch plate 2 toward the open position. This condition is depicted by FIG. 5.

As is seen from FIG. 1, to the housing 1, there is fixed a base plate 8 which extends upward from the housing 1. The base plate 8 constitutes part of the housing 1. To the base plate 8, there is mounted a control mechanism "D" of the lock proper "C".

Figure 3:
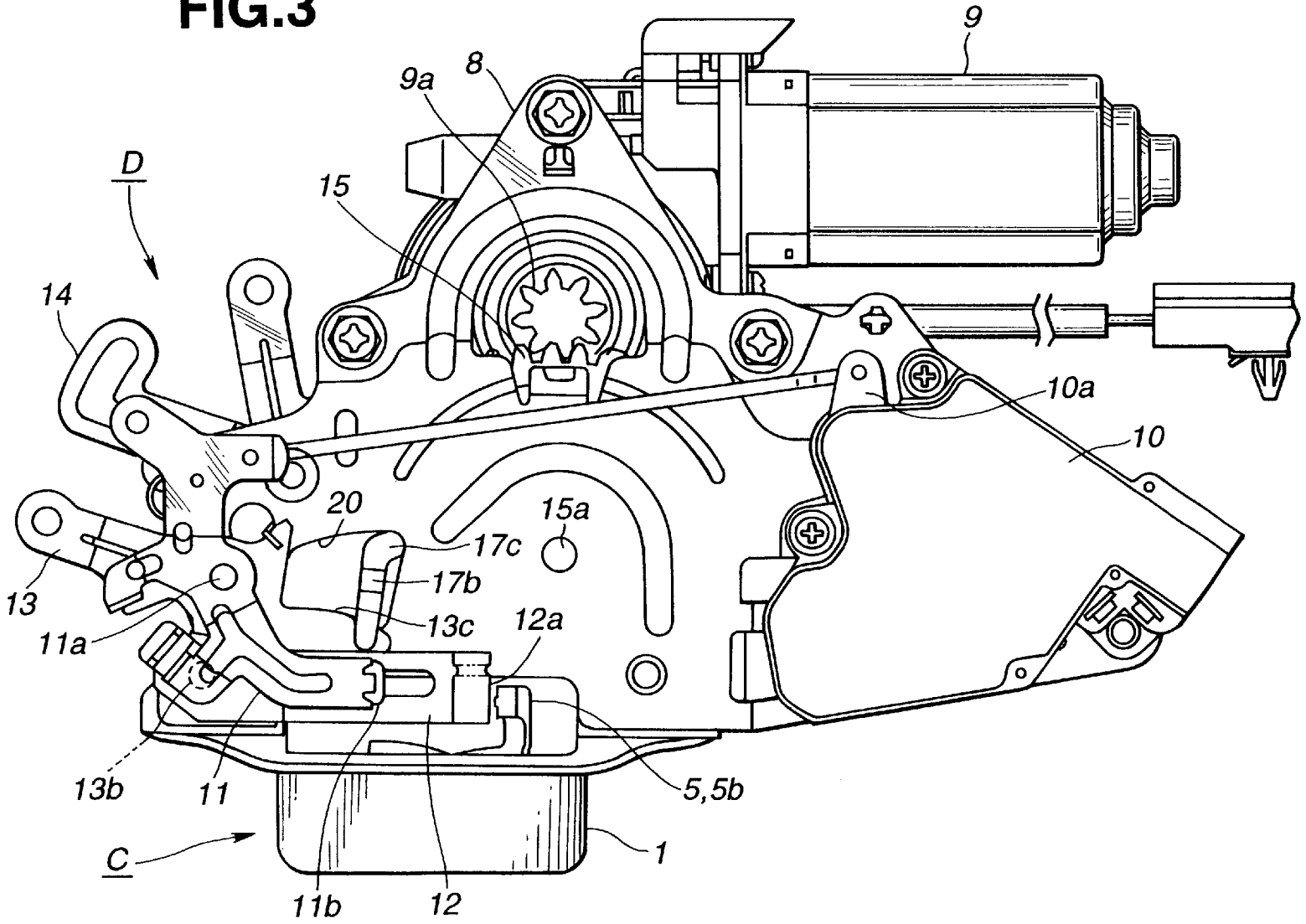
FIG. 3 is a back view of the electric door closure of the present invention with the electric motor mounted thereto.

As is best seen from FIG. 3, the control mechanism "D" comprises a reversible electric motor 9, a locking/unlocking actuator 10, a locking\unlocking lever 11 pivotally connected to the base plate 8 through a shaft 11*a*, a sub-lever 12 slidably supported by a supporting portion 11*b* of the locking/unlocking lever 11, an open lever 13 pivotally connected to the base plate 8 through the shaft 11*a*, a key lever 14 linked to a key cylinder (not shown) mounted on the back door "B", a sector gear 15 pivotally connected through a shaft 15*a* to the base plate 8, an arm member 15*b* integral with the sector gear 15 and extending downward beyond the shaft 15*a* and a connecting lever 17 (see FIG. 1) connected through a connecting shaft 16 to a lower end portion of the arm member 15*b*.

More specifically, as is seen from FIG. 3, the locking/unlocking lever 11 is linked to a drive lever 10*a* of the actuator 10 and is pivotal between a locking position and an unlocking position. The open lever 13 is linked to a latch canceling operation means (not shown) of the back door "B", which are, for example, an inside door handle, an outside door handle and the like. The shaft 15*a* of the sector gear 15 is oriented perpendicular to the shaft 3 of the latch plate 2, and the sector gear 15 is meshed with a pinion 9*a* of a speed reduction gear driven by the motor 9. The connecting shaft 16 (see FIG. 1) extends in parallel with the shaft 15*a* of the arm member 15*b*.

As is seen from FIG. 1, the motor 9, the key lever 14, the sector gear 15, the arm member 15*b* forming part of the sector gear 15 and the connecting lever 17 are mounted on a front side of the base plate 8, while, as is seen from FIG. 3, the actuator 10, the locking/unlocking lever 11, the sub-lever 12 and the open lever 13 are mounted on a back side of the base plate 8.

Figure 8:
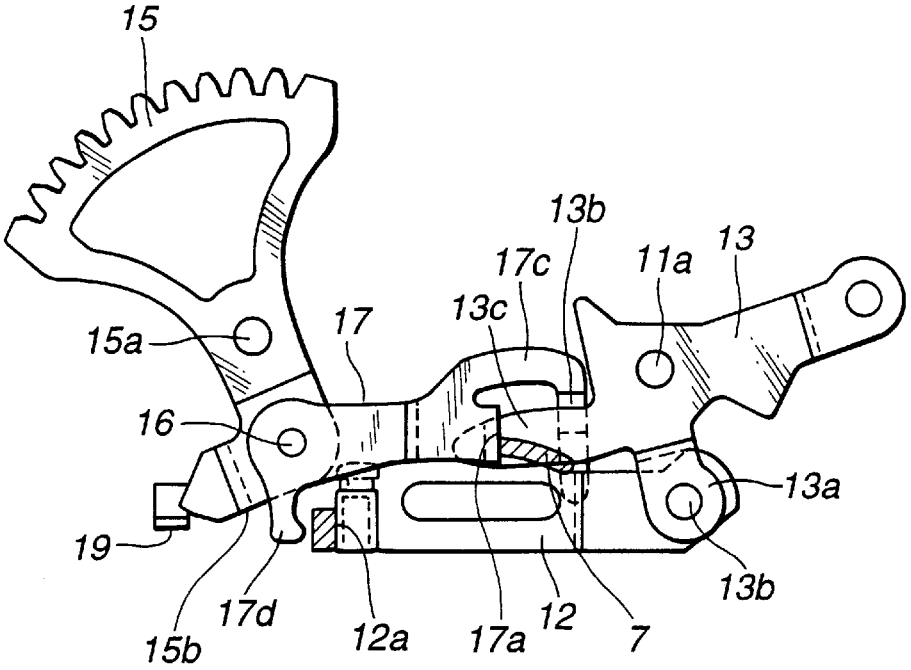
Figure 9:
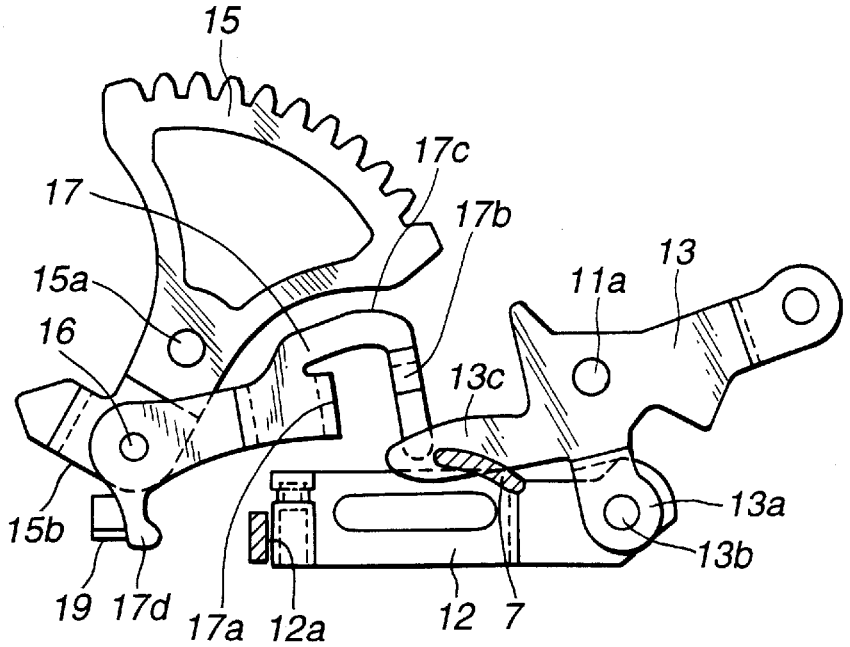
Figure 10:
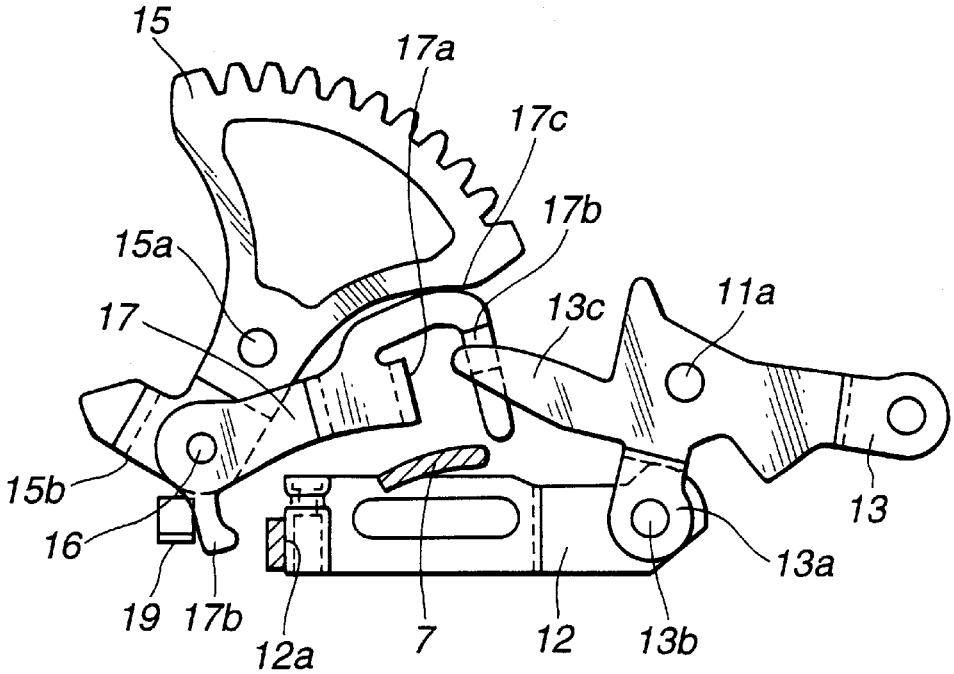

As is seen from FIGS. 6 to 10, the open lever 13 is formed with both a first arm portion 13*a* which extends downward and a second arm portion 13*c* which extends toward the connecting lever 17. One end of the sub-lever 12 is pivotally connected to the first arm portion 13*a* through a shaft 13*b*. When the latch canceling operation means (viz., inside door handle and/or outside door handle) is actuated, the open lever 13 is turned in a counterclockwise direction from the position shown in FIG. 6 to a latch canceling position as shown in FIG. 10.

Figure 6:
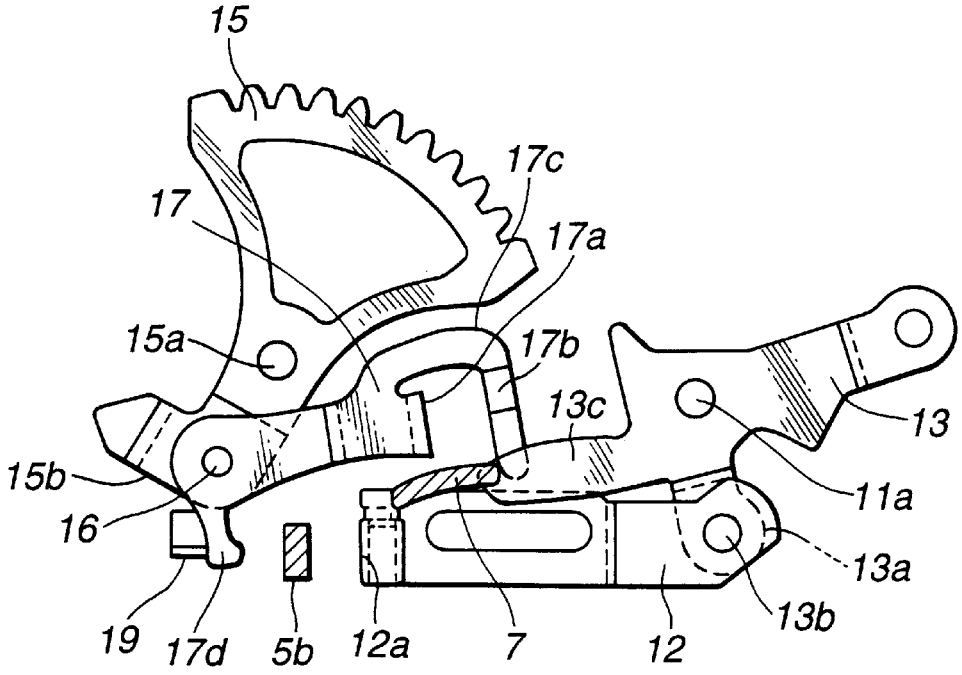
FIGS. 6 to 10 are front views of an essential portion of the electric door closure of the present invention, showing different operation conditions.

When, with the locking/unlocking lever 11 assuming the unlocking position as shown in FIG. 3 due to closed state of the back door "B", the open lever 13 is pivoted in a clockwise direction in FIG. 6 to effect a latch canceling, the sub-lever 12 is shifted leftward from the position of FIG. 6. With this, a left end portion 12*a* of the sub-lever 12 is brought into abutment with the engaging lug 5*b* of the locking plate 5 thereby to pivot the locking plate 5 in a direction to release the latch plate 2. Upon this, the back door "B" can be opened.

When, due to closing of the back door "B", the latch plate 2 is brought to the half-latch position, a half-latch detecting switch (not shown) causes the motor 9 to be energized to run in a normal direction, and when thereafter the latch plate 2 is brought to the full-latch position, a full-latch detecting switch (not shown) causes the motor 9 to run in a reversed direction. These two detecting switches are disclosed in U.S. Pat. No. 5,516,164.

Usually, the sector gear 15 is in its inoperative position as shown in FIGS. 1, 6, 9 and 10. However, due to the running of the motor 9 in the normal direction, the sector gear 15 is pivoted in a counterclockwise direction from the position of FIG. 6 to the position of FIG. 8 through the position of FIG. 7. Due to this pivoting of the sector gear 15, the latch plate 2 is brought to the full-latch position. Due to the running of the motor 9 in the reversed direction, the sector gear 15 is returned to the original inoperative position.

Figure 7:
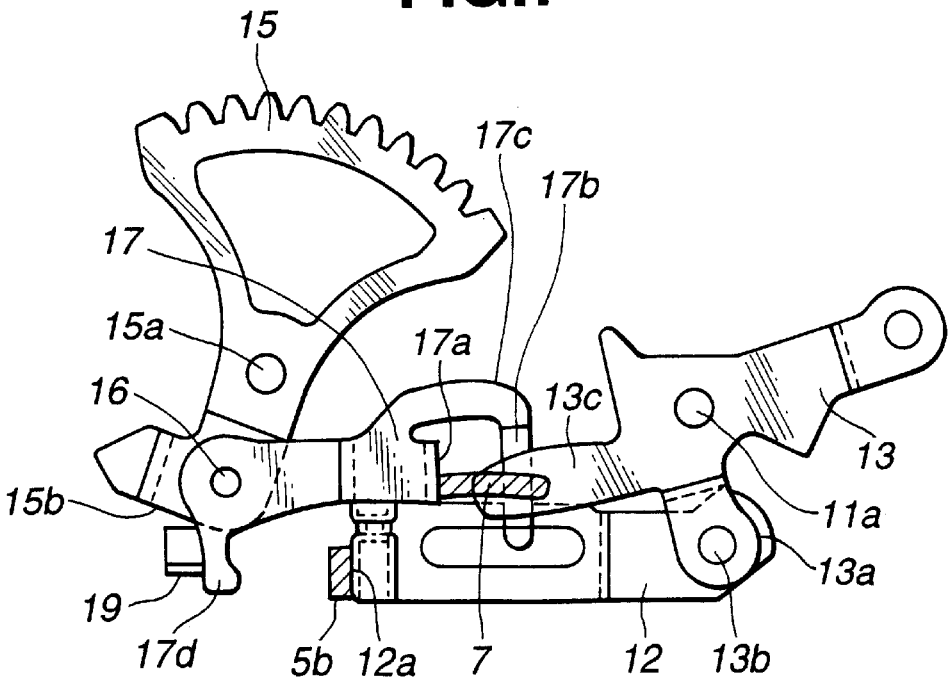

The connecting lever 17 can pivot between an engaging position as shown in FIGS. 7 and 8 and a canceling position as shown in FIGS. 6, 9 and 10. That is, when the connecting lever 17 assumes the engaging position, the push portion 17*a* of the connecting lever 17 abuts against the arcuate edge 7*d* of the rotation lever 7 permitting the rotation lever 7 and thus the latch plate 2 to pivot from the half-latch position to the full-latch position upon pivoting of the arm member 15*b* from a neutral position to an operative position. While, as is seen from FIG. 1, when the connecting lever 17 assumes the canceling position, the push portion 17*a* of the connecting lever 17 is separated from the leading part 7*b* in a direction perpendicular to a major surface of the leading part 7*b*. Usually, the connecting lever 17 is biased toward the engaging position due to a biasing force of a spring 18 (see FIG. 1). As shown, the spring 18 has a multi-turned center portion disposed about the pivot shaft 15*a*, one end hooked to a projection (no numeral) of the base portion 8 and the other end hooked to the connecting lever 17. When the sector gear 15 is returned from the neutral position of FIG. 7 to the inoperative position of FIG. 6, a projection 17*d* formed on the connecting lever 17 is brought into abutment with a stopper 19 provided on the base plate 8, so that the connecting lever 17 is pushed up to the canceling position and thus suppressed from moving toward the engaging position.

As is seen from FIG. 6, the connecting lever 17 is formed with a generally L-shaped right end portion 17*c*. A downward extending part of the L-shaped right end portion 17*c* is formed with a backward bent stepped part 17*b*, so that, as is seen from FIG. 1, the downward extending part is led into a back side of the base plate 8 through an aperture 20 formed in the base plate 8.

As is seen from FIG. 3, to the downward extending part of the connecting lever 17, there is engaged the second arm portion 13*c* of the above-mentioned open lever 13. Thus, when the open lever 13 is pivoted to the latch canceling position of FIG. 10, the second arm portion 13*c* thereof pushes up the stepped part 17*b* of the connecting lever 17, so that the connecting lever 17 is pivoted to the canceling position against the biasing force of the spring 18 (see FIG. 1).

As is seen from FIG. 1, because the second arm portion 13*c* of the open lever 13 is put between the downward extending part of the connecting lever 17 and the base plate 8, the operative engagement between the open lever 13 and the connecting lever 17 is assured. Furthermore, because a peripheral edge of the aperture 20 serves to guide the movement of the downward extending part, the pivotal movement of the connecting lever 17 is assuredly and smoothly carried out.

In the following, operation will be described with reference to FIGS. 6 to 13 of the drawings.

For ease of understanding, description will be commenced with respect to the open condition of the back door "B". In this condition, the lock proper "C" (see FIG. 2) mounted on the back proper "B" is separated from the striker 4 on the vehicle body "A", and the electric door closure assumes the condition as shown in FIGS. 6 and 11. That is, as is seen from FIG. 6, the sector gear 15 assumes the inoperative position, and the connecting lever 17 assumes the canceling position having the projection 17*d* contacted with the stopper 19. Thus, movement of the connecting lever 17 toward the engaging position is kept suppressed.

When, due to downward pivoting of the back door "B" to an almost closed position, the striker 4 is led into the latching recess 2*a* of the latch plate 2, the latch plate 2 is forced to pivot to the half-latch position. Upon this, the half-latch detecting switch causes the motor 9 to be energized to run in a normal direction, so that the sector gear 15 is pivoted in a counterclockwise direction in FIG. 6 from the inoperative position of FIG. 6 toward the operative position through the neutral position of FIG. 7.

Due to the counterclockwise pivoting of the sector gear 15 from the inoperative position of FIG. 6 to the neutral position of FIG. 7, the projection 17*d* of the connecting lever 17 is forced to move in a direction away from the stopper 19, so that the connecting lever 17 is gradually pivoted toward the engaging position due to the force of the spring 18 (see FIG. 1). Thus, when, as is seen from FIG. 7, the sector gear 15 reaches to the neutral position, the connecting lever 17 reaches to the engaging position having the push portion 17*a* thereof facing the edge 7*d* of the rotation lever 7 which has reached to the half-latch position.

Due to further counterclockwise pivoting of the sector gear 15 from the neutral position toward the operative position, the connecting lever 17 is moved straightly rightward to the position as shown in FIG. 8 pushing the edge 7*d* of the rotation lever 7 with the push portion 17*a*. With this, the rotation lever 7 (and thus the latch plate 2) is enforcedly pivoted from the half-latch position to the full-latch position, so that the back door "B" is fully closed and latched.

When the latch plate 2 is pivoted to the full-latch position, the pawl portion 5*a* of the locking plate 5 engages with the stepped portion 2*c* of the latch plate 2 and at the same time the full-latch detecting switch causes the motor 9 to run in a reversed direction. Thus, the sector gear 15 is returned to the inoperative position of FIG. 6.

When the sector gear 15 begins the returning movement, the push portion 17*a* of the connecting lever 17 is moved away from the edge 7*d* of the rotation lever 7 to instantly take the position of FIG. 7. During the returning movement of the sector gear 15 from the neutral position to the inoperative position, the projection 17*d* of the connecting lever 17 is brought into contact with the stopper 19, so that the connecting lever 17 is pushed up to the canceling position of FIG. 9 and held in this canceling position.

When, with the back door "B" assuming the above-mentioned fully closed latched position, the latch canceling operating means (viz., inside door handle, outside door handle or the like) is operated, the open lever 13 is pivoted in a clockwise direction from the position of FIG. 9 to a latch canceling position of FIG. 10. With this, the sub-lever 12 is moved leftward in FIG. 10 by the first arm portion 13*a* of the open lever 13 causing the left end portion 12*a* thereof to push the engaging lug 5*b* of the locking plate 5. With this pushing, the locking plate 5 is pivoted to a canceling position of FIG. 13, so that the latch plate 2 can freely pivot to the open position of FIG. 6 without being interrupted by the connecting lever 17 which has been kept in the canceling position. Thus, under this condition, the back door "B" can be opened when applied with a certain force in a direction to open the door "B".

When, during the above-mentioned door closing operation of the door closure from the condition of FIG. 7 to the condition of FIG. 8, the open lever 13 is pivoted to the latch canceling position of FIG. 10 due to operation of the latch canceling operation means, the locking plate 5 is forced to turn to the canceling position, and at the same time, the second arm portion 13*c* of the open lever 13 pushes up the stepped part 17*b* of the connecting lever 17 thereby to pivot the connecting lever 17 to the canceling position against the force of the spring 18. With this, the striker 4 is instantly released from the latch plate 2, so that the back door "B" can be opened instantly. That is, even if the back door "B" is pivoted to the fully closed latched position with a foreign thing pinched between the door "B" and the vehicle body "A", the back door "B" can be instantly opened by only manipulating the latch canceling operation means.

In the following, advantages of the present invention will be described.

(a) Just before the latch plate 2 reaches to the half-latch position from the open position, the connecting lever 17 is forced to assume the engaging position due to the force of the spring 18. Just after the electric actuator is energized upon sensing the latch plate 2 reaching the half-latch position, the connecting lever 17 pushes the rotation lever 7 to instantly pivot the latch plate 2 to the full-latch position. That is, unlike the case of the above-mentioned conventional door closure, in the present invention, there is no time-loss in closing the door "B".

(b) The shaft 15*a* of the sector gear 15 (viz., the arm member 15*b*) is oriented perpendicular to the shaft 3 of the latch plate 2, so that the connecting lever 17 can contact the rotation lever 7 at right angles for suppressing movement toward the engaging position. Thus, even if the connecting lever 17 and the rotation lever 7 are subjected to a deformation or assembly error, the engagement between the connecting lever 17 and the rotation lever 7 is assuredly kept.

(c) When, during the door closing opening of the door closure, the latch canceling operation means (viz., inside door handle, outside door handle or the like) is operated, the connecting lever 17 and the locking plate 5 are assuredly moved to the respective canceling positions by the open lever 13. With this, the striker 4 is instantly released from the latch plate 2, and thus the back door "B" can be freely opened. Thus, even if the back door "B" is pivoted to the fully closed latched position with a foreign thing pinched between the door "B" and the vehicle body "A", the back door "B" can be instantly opened by only manipulating the latch canceling operation means.

(d) The operative connection between the connecting lever 17 and the open lever 13 is made through the aperture 20 formed in the base plate 8. The peripheral edge of the aperture 20 serves to guide the movement of the connecting lever 17, so that the movement of the connecting lever 17 is assuredly and smoothly carried out.

(e) The leading part 7*b* of the rotation lever 7 is bent by a certain angle relative to the base part 7*a*, so that the leading part 7*b* extends generally in parallel with the pivot shaft 15*a* of the sector gear 15. Thus, the connecting lever 17 can contact the leading part 7*b* of the rotation lever 7 at right angles. Thus, the engagement between the connecting lever 17 and the rotation lever 7 is assuredly held.

(f) By the slight movement of the arm member 15*b* (viz., sector gear 15) achieved when the motor 9 starts to operate, the connecting lever 17 can be instantly pivoted to the engaging position to engage with the rotation lever 7. Thus, undesired time loss from the time when the latch plate 2 reaches to the half-latch position to the time when the latch plate 2 is actually driven by the electric actuator can be minimized.

(g) Under inoperative condition of the electric door closure, the connecting lever 17 is kept pushed up to the canceling position by the stopper 19 and thus the push portion 17*a* is sufficiently separated from the rotation lever 7. Thus, under the inoperative condition of the electric door closure, there is produced no noises caused by sliding engagement between the connecting lever 17 and the rotation lever 7.

The entire contents of Japanese Patent Applications P9-359710 (filed Dec. 26, 1997) and P9-359711 (filed Dec. 26, 1997) are incorporated herein by reference.

Although the invention has been described above by reference to a certain embodiment of the invention, the invention is not limited to it. Modifications and variations of the embodiment described above will occur to those skilled in the art, in light of the above teachings.

What is claimed is:

1. An electric door closure for use with a door lock device, said door lock device including a striker mounted on one of a fixed structure and a door movably connected to said fixed structure, and a lock proper mounted on the other of the fixed structure and the door, said lock proper including a latch plate which can pivot to an open position, a full-latch position and a half-latch position intermediate of the open position and the full-latch position, and a locking lever which can engage said latch plate to assure the half-latch and full-latch positions of said latch plate, said electric door closure comprising:

a rotation lever connected to a first rotation shaft of said latch plate to rotate therewith;

an electric actuator mounted in said lock proper;

an arm member pivotally connected to said lock proper through a second rotation shaft which is angled relative to said first rotation shaft, said arm member being pivoted by said electric actuator between an operative position and an inoperative position;

a connecting lever pivotally connected to said arm member through a third rotation shaft which extends parallel with said second rotation shaft, a press portion formed on said connecting lever pushing an edge of said rotation lever to pivot said latch plate from said half-latch position to said full latch position when said arm member is pivoted from said inoperative position to said operative position, said connecting lever being movable between an engaging position wherein said press portion of said connecting lever pushes said edge of said rotation lever and a canceling position wherein said press portion is separated from said rotation lever in a direction perpendicular to a major surface of said rotation lever, said press portion being in abutment with said edge of said rotation lever to suppress said connecting lever from moving toward said engaging position when said latch plate is in a zone between said open position and just before said half-latch position;

an open lever which moves said connecting lever and said locking plate to the respective canceling positions when actuated in a canceling direction; and biasing means for biasing said connecting lever toward said engaging position.

2. An electric door closure as claimed in claim 1, in which an axis of said second rotation shaft is perpendicular to an axis of said first rotation shaft.

3. An electric door closure as claimed in claim 1, in which said connecting lever has an extending part which passes through an aperture formed in a base plate of said lock proper and is operatively engaged with said open lever.

4. An electric door closure as claimed in claim 3, in which said extending part of said connecting lever is formed with a stepped part against which said open lever abuts upon pivoting of said open lever in the canceling direction.

5. An electric door closure as claimed in claim 1, in which a leading end of said rotation lever extends in a direction parallel with the axis of said second rotation shaft.

6. An electric door closure for use with a door lock device including a striker mounted on one of a fixed structure and a door movably connected to said fixed structure, and a lock proper mounted on the other of the fixed structure and the door, said lock proper including a latch plate which can pivot to an open position, a half-latch position and a full-latch position and a locking lever which can engage said latch plate to assure the half-latch and full-latch positions of said latch plate, said electric door closure comprising:

a rotation lever connected to a shaft of said latch plate to rotate therewith;

an electric actuator mounted in said lock proper;

an arm member pivotally connected to said lock proper, said arm member being pivoted by said electric actuator between an operative position and an inoperative position;

a connecting lever pivotally connected to said arm member, a press portion formed on said connecting lever pushes an edge of said rotation lever to pivot said latch plate from said half-latched position to said full latch position and a canceling lever wherein said press portion is spaced from said rotation lever, said connecting lever being movable between an engaging position wherein when said arm member is pivoted from said inoperative position to said operative position;

biasing means for biasing said connecting lever toward said engaging position; and a stopper against which a projection of the connecting lever abuts when said arm member is pivoted from a neutral position between said operative and inoperative positions to said inoperative position, and so that said connecting lever is pivoted to the canceling position.

7. An electric door closure as claimed in claim 6, further comprising an open lever which moves said connecting lever and said locking plate to the respective canceling positions when actuated in the canceling direction.

8. An electric door closure as claimed in claim 6, in which said biasing means is a coil spring.

* * * * *